US008388554B2

(12) United States Patent
Oshima et al.

(10) Patent No.: US 8,388,554 B2
(45) Date of Patent: Mar. 5, 2013

(54) PHYSICAL EXERCISE ASSISTING DEVICE

(75) Inventors: Yoshitake Oshima, Kyoto (JP); Kiichiro Miyata, Toyonaka (JP); Koichi Tanaka, Kyoto (JP)

(73) Assignee: Omron Healthcare Co., Ltd., Kyoto-shi (JP)

( * ) Notice: Subject to any disclaimer, the term of this patent is extended or adjusted under 35 U.S.C. 154(b) by 572 days.

(21) Appl. No.: 12/447,421

(22) PCT Filed: Oct. 3, 2007

(86) PCT No.: PCT/JP2007/069349

§ 371 (c)(1),
(2), (4) Date: Jan. 6, 2010

(87) PCT Pub. No.: WO2008/050590

PCT Pub. Date: May 2, 2008

(65) Prior Publication Data

US 2010/0137106 A1 Jun. 3, 2010

(30) Foreign Application Priority Data

Oct. 27, 2006 (JP) ..... 2006-292078

(51) Int. Cl.
*A61B 5/103* (2006.01)
*A63B 71/00* (2006.01)

(52) U.S. Cl. ..... 600/587; 600/595; 482/1; 482/8

(58) Field of Classification Search ..... 482/1, 8–9; 600/595, 587

See application file for complete search history.

(56) References Cited

U.S. PATENT DOCUMENTS

| | | | | |
|---|---|---|---|---|
| 5,788,655 | A | 8/1998 | Yoshimura et al. | |
| 5,989,200 | A | 11/1999 | Yoshimura et al. | |
| 6,013,008 | A * | 1/2000 | Fukushima | 482/8 |
| 6,135,951 | A * | 10/2000 | Richardson et al. | 600/300 |

(Continued)

FOREIGN PATENT DOCUMENTS

| | | |
|---|---|---|
| GB | 2 424 840 | 10/2006 |
| JP | 08-126632 | 5/1996 |

(Continued)

OTHER PUBLICATIONS

Russian Decision on Grant dated Jul. 13, 2010 directed to counterpart Russian Application No. 2009120028/14(027601); 8 pages.

*Primary Examiner* — Loan Thanh
*Assistant Examiner* — Sundhara Ganesan
(74) *Attorney, Agent, or Firm* — Morrison & Foerster LLP

(57) ABSTRACT

A physical exercise assisting device includes a physical activity amount recorder recording a performed physical activity amount such that a physical exercise amount and a lifestyle activity amount can be recognized for a physical activity that has an intensity greater than or equal to a reference intensity; goal storage unit storing goals for the physical activity amount and the physical exercise amount to be performed in a predetermined unit period; and a display displaying goal achievement of the physical activity amount and the physical exercise amount based on the physical activity amount and the physical exercise amount recorded by the physical activity amount recorder and the goals stored in the goal storage unit.

10 Claims, 8 Drawing Sheets

U.S. PATENT DOCUMENTS

| | | | | |
|---|---|---|---|---|
| 6,705,972 | B1 * | 3/2004 | Takano et al. | 482/8 |
| 6,821,229 | B2 * | 11/2004 | Sato et al. | 482/8 |
| 7,070,539 | B2 | 7/2006 | Brown et al. | |
| 7,169,084 | B2 * | 1/2007 | Tsuji | 482/8 |
| 7,297,088 | B2 * | 11/2007 | Tsuji | 482/3 |
| 7,421,369 | B2 * | 9/2008 | Clarkson | 702/150 |
| 7,559,877 | B2 * | 7/2009 | Parks et al. | 482/8 |
| 7,601,098 | B1 * | 10/2009 | Lee et al. | 482/8 |
| 7,618,347 | B2 * | 11/2009 | Yeo et al. | 482/8 |
| 7,662,065 | B1 * | 2/2010 | Kahn et al. | 482/9 |
| 7,713,173 | B2 * | 5/2010 | Shin et al. | 482/8 |
| 7,728,723 | B2 * | 6/2010 | Niva et al. | 340/539.11 |
| 7,736,272 | B2 * | 6/2010 | Martens | 482/8 |
| 7,840,346 | B2 * | 11/2010 | Huhtala et al. | 701/439 |
| 7,867,141 | B2 * | 1/2011 | Matsumura et al. | 482/8 |
| 7,867,142 | B2 * | 1/2011 | Kim et al. | 482/8 |
| 7,942,833 | B2 * | 5/2011 | Yasuhara | 600/595 |
| 2004/0067476 | A1 | 4/2004 | Reck et al. | |
| 2005/0113650 | A1 * | 5/2005 | Pacione et al. | 600/300 |
| 2005/0172311 | A1 * | 8/2005 | Hjelt et al. | 725/10 |

FOREIGN PATENT DOCUMENTS

| | | |
|---|---|---|
| JP | 10-318779 | 12/1998 |
| JP | 2001-276009 | 10/2001 |
| JP | 2004-097649 | 4/2004 |
| JP | 2005-092496 | 4/2005 |
| JP | 2005-270412 | 10/2005 |
| SU | 1581280 | 7/1990 |
| WO | WO-93/16636 | 9/1993 |

* cited by examiner

Fig. 5

| Date | Day of week | Lifestyle activity amount | Physical exercise amount |
|---|---|---|---|
| 2006/10/22 | Sunday | 3 | 2 |
| 2006/10/21 | Saturday | 3 | 1 |
| 2006/10/20 | Friday | 2 | 0 |
| 2006/10/19 | Thursday | 2 | 0 |
| : | : | : | : |
| 2006/9/13 | Wednesday | 2 | 0 |
| 2006/9/12 | Tuesday | 2 | 0 |
| : | : | : | : |
| : | : | : | : |

Fig. 7

30

| Activity content | Physical exercise /lifestyle activity | Intensity (mets) |
|---|---|---|
| Bowling | Physical exercise | 3. 0 |
| Golf (use cart) | Physical exercise | 3. 5 |
| Aquabics | Physical exercise | 4. 0 |
| Aerobics | Physical exercise | 6. 5 |
| : | : | : |
| Floor cleaning | Lifestyle activity | 3. 0 |
| Mopping | Lifestyle activity | 3. 5 |
| Pulling weeds of garden | Lifestyle activity | 4. 5 |
| : | : | : |

31

Type of physical activity?

Golf (use cart)/ physical exercise

Performing time?

120 minutes

PHYSICAL EXERCISE ASSISTING DEVICE

REFERENCE TO RELATED APPLICATIONS

This application is a national stage application under 35 USC 371 of International Application No. PCT/JP2007/069349, filed Oct. 3, 2007, which claims the priority of Japanese Patent Application No. 2006-292078, filed Oct. 27, 2006, the contents of both of which prior applications are incorporated herein by reference.

FIELD OF THE INVENTION

The present invention relates to a physical exercise assisting device for assisting a physical exercise of a user.

BACKGROUND OF THE INVENTION

A pedometer and a physical exercise intensity meter are known as a device for assisting a physical exercise of a user. The conventional pedometer and physical exercise intensity meter include those which display the remaining number of steps and the remaining physical exercise amount at a certain time point with respect to the preset target number of steps and a target physical exercise amount (see Patent Documents 1 and 2). A physical exercise intensity meter that classifies the detected physical activity to a physical exercise level of four stages, and displaying the number of walks, physical exercise intensity distribution, and the like of a constant period is known (see Patent Document 3).

[Patent Document 1] Japanese Unexamined Patent Publication No. 2005-92496

[Patent Document 2] Japanese Unexamined Patent Publication No. 2001-276009

[Patent Document 3] Japanese Unexamined Patent Publication No. 10-318779

SUMMARY

In recent years, the percentage of lifestyle-related diseases such as ischemic heart disease, cerebrovascular disease and diabetes with respect to the entire disease is increasing and becoming a large problem. In order to reduce the risk for developing such lifestyle-related disease, improving the metabolic syndrome (visceral fat syndrome), which is the basic clinical condition, by reviewing the non-preferable lifestyle such as lack of physical exercise is known to be effective.

As a specific guideline, in "exercise criteria 2006 for positive health" and "exercise guideline 2006 for positive health (exercise guide 2006)" reported as part of the exercise measures of Ministry of Health, Labor, and Welfare, the reference value of the physical activity amount for positive health is defined as "23 exercises (met/time)/week for physical activity of three or more mets, 4 exercises for physical exercise of three or more mets". The "physical activity" refers to all movements that consume greater energy than in a resting state, where "physical exercise" refers to that which is performed intentionally according to plan for the purpose of maintaining and enhancing the physical strength of the physical activity. The physical activities other than the physical exercise are referred to as "lifestyle activity".

As apparent from the above guideline, it is effective to consider both increasing the activity amount in the daily life (e.g., increasing activity amount in households and in commuting etc.) and exercising according to plan to a certain extent (e.g., walking, jogging, etc. on a regular basis) and continuing the same to prevent lifestyle-related diseases in advance. However, in the conventional pedometer and physical exercise intensity meter, the performed amount and the goal of the lifestyle activity and the physical exercise cannot be managed in a distinguished manner, and it is difficult to perform the effective physical activity along the guideline.

In view of the above situations, it is an object of the present invention to provide a physical exercise assisting device capable of easily managing and checking the performance status of the entire physical activity and the physical exercise amount included therein, and effectively assisting the user in continuing the physical exercise.

In order to achieve the above object, the present invention adopts the following configuration.

A physical exercise assisting device of the present invention includes physical activity amount recording means for recording a performed physical activity amount such that content of a physical exercise amount and a lifestyle activity amount can be recognized for a physical activity of greater than or equal to a reference intensity; goal storage means for storing goals for the physical activity amount and the physical exercise amount to be performed in a predetermined unit period; and display means for displaying a goal achievement of the physical activity amount and the physical exercise amount based on the physical activity amount and the physical exercise amount recorded by the physical activity amount recording means and the goals stored in the goal storage means.

According to such a configuration, the user can easily manage the performance status of the physical activity and the physical exercise, and can also easily understand the remaining physical activity amount necessary for achieving the goal and the content thereof (whether physical exercise is necessary, or lifestyle activity is enough). This effectively assists the user in continuing the physical exercise (goal achievement).

The physical activity amount recording means preferably includes detection means for detecting a physical activity of a user, and calculates an intensity and the physical activity amount of the physical activity performed by the user based on the detection result of the detection means. According to such a configuration, the intensity and the amount of physical activity performed by the user can be automatically calculated and recorded. For example, using an acceleration sensor for the detection means, the intensity and the amount of walking (including fast walking and jogging) serving as the physical activity are calculated by analyzing the output waveform of the acceleration sensor.

The physical activity amount recording means preferably records the physical activity amount only when the physical activity of greater than or equal to the reference intensity is continuously performed for longer than or equal to a predetermined time. According to such a configuration, the physical activity of greater than or equal to the reference intensity needs to be collectively performed to a certain extent to be recorded as a record, and thus the user can be reminded of consciousness (forwardness) for carrying out active physical activity. The physical activity amount recording means preferably dynamically changes the length of the predetermined time according to the intensity of the physical activity. For example, the physical activity can be recorded in a shorter time the larger the intensity, and thus the motivation to perform the physical exercise of large intensity can be provided to the user.

The physical activity amount recording means preferably determines whether to assume a physical activity amount as the physical exercise amount or a lifestyle activity amount based on a magnitude of the continuously performed physical activity amount. In other words, if the physical activity is collectively performed to a certain extent, judgment is made that it is performed intentionally according to plan (=physical exercise) for the purpose of maintaining and enhancing the physical strength. Alternatively, the physical activity amount recording means may simply determine whether to assume a physical activity amount as the physical exercise amount or the lifestyle activity amount based on the magnitude of the calculated intensity. According to such a configuration, the physical exercise and the lifestyle activity are automatically distinguished.

The physical activity amount recording means preferably includes a physical activity intensity table in which type and intensity of a physical activity are corresponded, and input means for the user to input a type and a performing time of the physical activity, and calculates and records a physical activity amount for a physical activity of a type different from the physical activity detectable with the detection means based on the input of the user. According to such a configuration, the physical activity amount of the physical activity of the type difficult to automatically detect can be recorded.

The physical activity recording means preferably records a performed physical activity amount for a physical activity of smaller than the reference intensity; and the display means preferably displays the physical activity amount of smaller than the reference intensity in distinction from the physical activity amount of greater than or equal to the reference intensity. Through such a display, whether the performed physical activity has an intensity contributing to achieving the goal (typically, effective in preventing the lifestyle-related disease in advance) can be easily checked, and thus the user is expected to perform an active physical activity on a routine basis.

Achievement estimating means is preferably further arranged for estimating a goal achievement at a terminating time point of a current unit period from a history of the physical activity recorded in the past unit period and a history of the physical activity amount recorded from the start to the current time point of the current unit period. The user can adjust the pace of performing the physical activity by looking at the estimated result of the goal achievement.

Goal setting means for setting the goal, the goal setting means being switchable to change or not change the setting of the goal is further preferably arranged. According to such a configuration, an appropriate goal corresponding to each user can be set. Furthermore, use can be made such that only the management instructor having professional knowledge is permitted to change the setting of the goal and the actual user is prohibited to change the goal without asking.

According to the present invention, the performance status of the entire physical activity and the physical exercise amount included therein can be easily managed and checked, thereby effectively assisting the user in continuing the physical exercise.

BRIEF DESCRIPTION OF THE DRAWINGS

FIG. 5 is a view showing one example of the physical activity amount data recorded in a memory.

FIG. 7 is a view showing an example of manually inputting type and performing time of the physical activity.

DETAILED DESCRIPTION OF THE INVENTION

Preferred embodiments of the present invention will be illustratively described in detail hereinafter with reference to the drawings.

(Configuration of Physical Exercise Intensity Meter)

Figure 1:
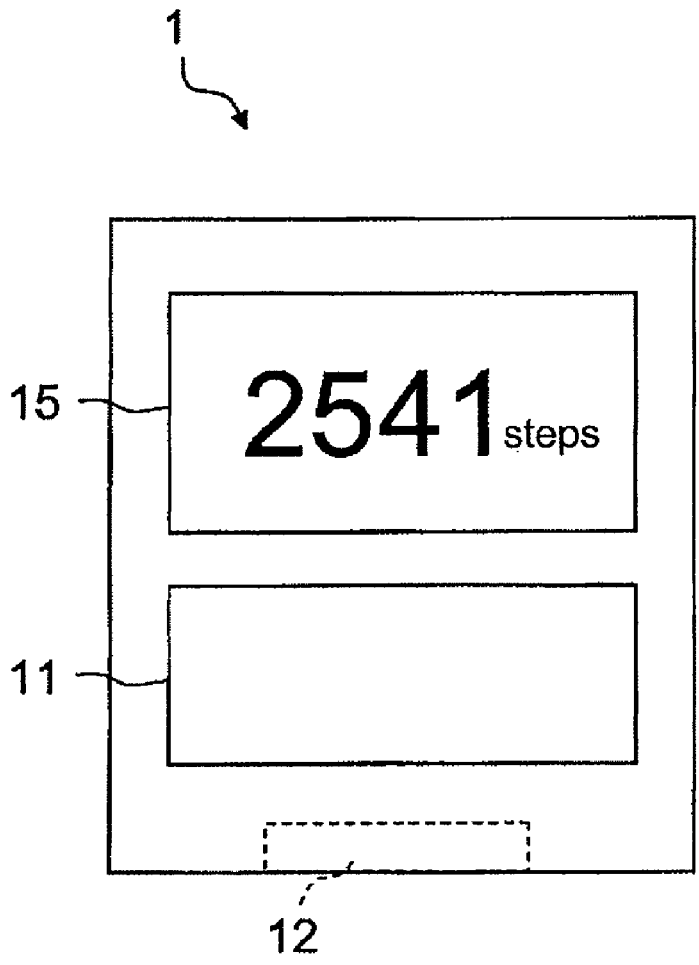
FIG. 1 is a view showing an outer appearance of a physical exercise intensity meter.
Figure 2:
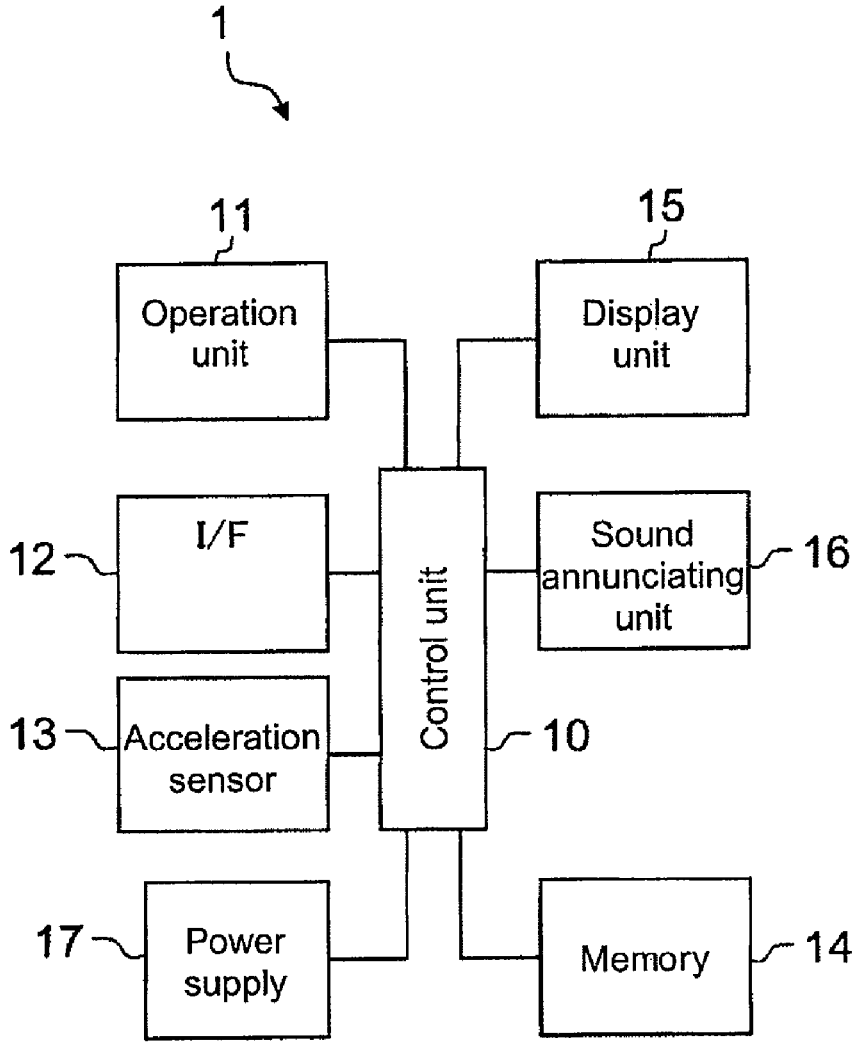
FIG. 2 is a block diagram showing an internal configuration of the physical exercise intensity meter.

FIG. 1 is a view showing an outer appearance of a physical exercise intensity meter serving as a physical exercise assisting device, and FIG. 2 is a block diagram showing an internal configuration of the physical exercise intensity meter. As shown in FIGS. 1 and 2, a physical exercise intensity meter 1 includes a control unit 10, an operation unit 11, an I/F 12, an acceleration sensor 13, a memory 14, a display unit 15, a sound annunciating unit 16, a power supply 17, and the like.

The control unit 10 is configured by a microcomputer and the like, and has a function of executing various computation processing such as detecting physical activity, calculating and recording physical activity amount, and displaying performance status, as well as, controlling the display unit 15 and the sound annunciating unit 16 according to a program stored in advance. The details of the functions of the control unit 10 will be hereinafter described.

The operation unit 11 is a user interface for performing operations such as setting a goal, resetting the number of steps and the display, and inputting various set values. The I/F 12 is an external interface for transmitting/receiving data, in wireless communication or wired communication, with an external device such as a body composition meter or a personal computer. The acceleration sensor 13 is detection means for detecting the physical activity such as walking and running. The memory 14 is non-volatile storage means for storing data such as the number of steps, performance status and goal value of the physical activity amount, information about the user, various set values and table used by a program, and the like. The display unit 15 is display means configured by an LCD (Liquid Crystal Display), and displays information such as the number of steps, the performance status and goal attainment level of the physical activity. The sound annunciating unit 16 has a function of generating an operation sound, walking pitch sound, alarm sound and the like according to the control of the control unit 10.

The physical exercise intensity meter 1 has the following functions to achieve health management (physical exercise assistance) along the physical exercise guideline proposed in the "exercise guide 2006" mentioned above.

The "physical activity" of humans is handled by distinguishing it to "physical exercise" and "lifestyle activity". The "physical activity" refers to all movements that consume greater energy than in a resting state, where the "physical exercise" refers to that which is performed intentionally according to plan for the purpose of maintaining and enhancing the physical strength of the physical activity, and the "lifestyle activity" refers to physical activities other than the physical exercise.

Met (metabolic equivalent) is used as a unit of intensity of the physical activity, and exercise (=met·time) is used as a unit of amount of physical activity.

As a goal per unit period (e.g., one week), the goal value of the physical activity amount and the goal value of the physical exercise amount can be individually set. A default value is "23 exercises/week for physical activity, 4 exercises for physical exercise", but the setting of the goal can be changed at the operation unit (goal setting means) 11. This is because the appropriate goal value differs depending on the age, the physical strength, and the like of the user.

(Operation of Physical Exercise Intensity Meter)

A specific operation of the physical exercise intensity meter 1 will be described below.

(1) Detecting Physical Activity

Figure 3:
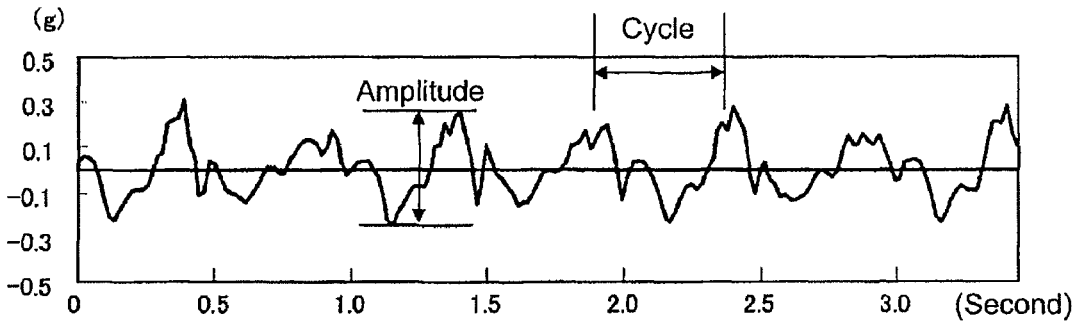
FIG. 3 is a view showing one example of an output waveform of an acceleration sensor in time of walking.

When the user performs a physical activity (walking, fast walking, jogging, etc.) while attaching or carrying around the physical exercise intensity meter 1, the vibration is detected by the acceleration sensor 13. FIG. 3 shows one example of an output waveform of the acceleration sensor 13 in time of walking. The unit of the horizontal axis of FIG. 3 is "second", and the unit of the vertical axis is "g (gravitational acceleration)". Looking at the output waveform, it can be recognized that a peak appears in substantially a constant cycle. The number of peaks corresponds to the number of steps, and the number of steps (inverse number of cycle) per unit time corresponds to the pitch. The amplitude (amount of change in acceleration) is proportional to the size of the stride.

The control unit 10 calculates the intensity of the physical activity performed by the user based on the detection result. Various methods are known for the method of calculating (estimating method) the intensity, but any method may be adopted. Two methods are illustrated by way of example, (a) a method of obtaining intensity from the pitch, and (b) a method of obtaining intensity from the pitch and the stride.

(a) Method of Obtaining Intensity from the Pitch

When a pitch P [step/min.] is obtained from the output waveform of the acceleration sensor 13, the intensity M [met] is obtained from the following equation.

$$\text{Intensity } M = a1 + (a2 \times \text{pitch } P)$$

Here, a1 and a2 are coefficients defined experimentally and statistically. For instance, a1=−7.065 and a2=0.105 for male, and a1=−8.805 and a2=0.110 for female.

(b) Method of Obtaining Intensity from the Pitch and the Stride

When a pitch P [step/min.] and a stride W [g] are obtained from the output waveform of the acceleration sensor 13, the intensity M [met] is obtained from the following equation.

$$\text{Intensity } M = b1 \times \text{pitch } P \times \text{stride } W + b2$$

Here, b1 and b2 are coefficients defined experimentally and statistically. For instance, b1=0.015 and b2=1.599.

Generally, it is known that the intensity of the physical activity increases as the pitch becomes faster or the stride becomes longer. Thus, the intensity of the physical activity actually performed by the user can be more accurately calculated by taking into consideration both the pitch and the stride as in the method of (b) as opposed to the method of (a).

(2) Calculating and Recording Physical Activity Amount

The calculation process and the recordation process of the physical activity amount in the control unit 10 will be described using the example of FIG. 4.

Figure 4:
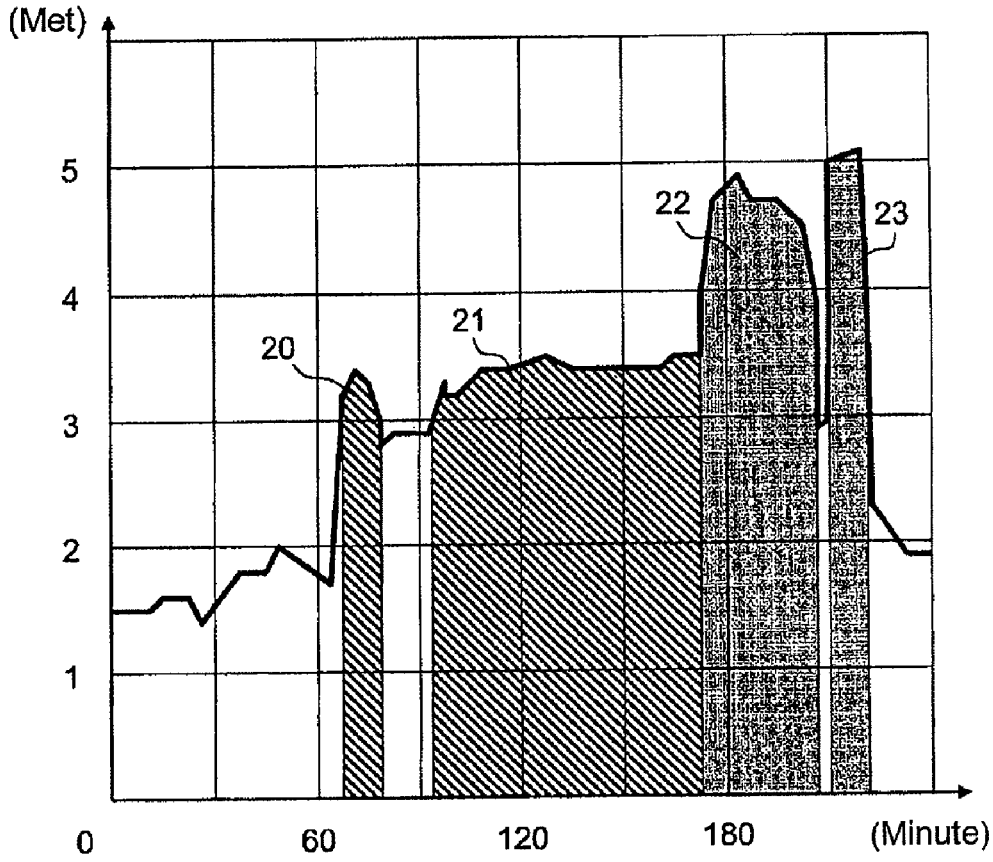
FIG. 4 is a graph showing transition of intensity of the physical activity.
Figure 6A:
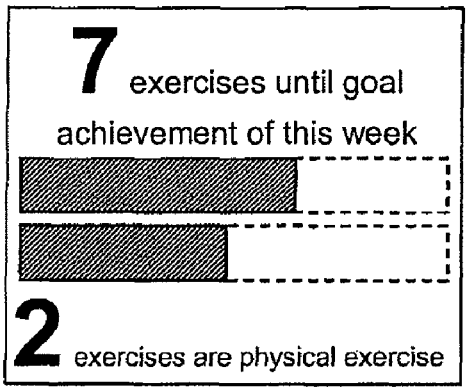
FIGS. 6(*a*) to 6(*d*) are views showing one example of a performance status check screen.
Figure 6B:
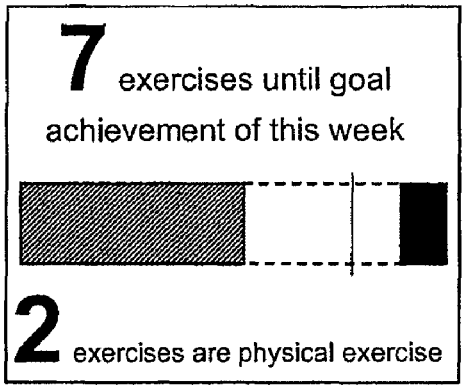
Figure 6C:
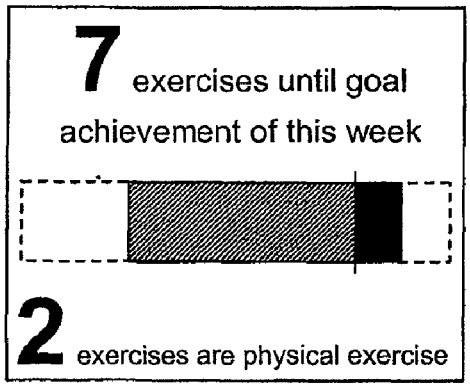
Figure 6D:
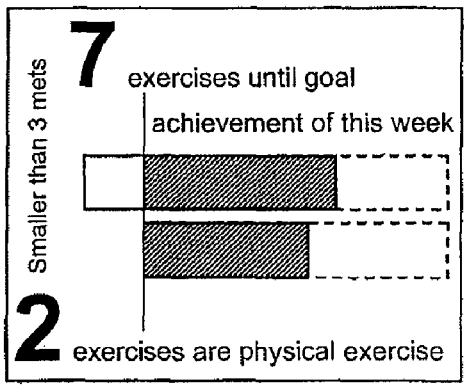

FIG. 4 is a graph showing transition of intensity of the physical activity calculated from the detection result of the acceleration sensor 13, where the horizontal axis indicates time (minute) and the vertical axis indicates intensity (met). According to such a graph, the physical activity of about 3 to 3.5 mets is performed between about 70 to 170 minutes, and the physical activity of about 4.5 to 5 mets is performed between about 170 to 220 minutes.

The control unit 10 of the present embodiment defines 3 mets as the reference intensity, where the physical activity that does not meet the reference intensity is excluded from the calculation of the physical activity amount. This is because it is not greatly effective in preventing lifestyle-related diseases in advance unless a physical activity active to a certain extent is performed. In the example of FIG. 4, the physical activity amount of the white portion of the graph is assumed as zero.

With regards to the physical activity of greater than or equal to the reference intensity, the control unit 10 performs time integration of the intensity (met) to calculate the physical activity amount (exercise=met·time). In this case, the control unit 10 classifies the physical activity into "lifestyle activity" and "physical exercise" based on the magnitude of the intensity of the physical activity. Specifically, the physical activity of greater than or equal to 3 mets and smaller than 4 mets is assumed as the "lifestyle activity", and the physical activity of greater than or equal to 4 mets is assumed as the "physical exercise". Here, 3 mets correspond to ordinary walking (about 67 m/min.), and 4 mets correspond to fast walking (about 95 to 100 m/min.). In the example of FIG. 4, the areas of shaded portions 20, 21 of the graph are calculated as the "lifestyle activity amount", and the areas of gray portions 22, 23 of the graph are calculated as the "physical exercise amount".

The control unit 10 records and stores, as needed, the physical activity amount calculated in the above manner in the memory 14. In this case, recording needs to be made such that the content of the lifestyle activity amount and the physical exercise amount can be recognized. This is because the goal management is performed on the entire physical activity amount (total of lifestyle activity amount and physical exercise amount) and the physical exercise amount. The timing of recordation to the memory 14 may be recording the physical activity amount every constant period (e.g., every one hour), or recording the same every time the physical activity amount of a constant amount (e.g., one exercise) is reached.

FIG. 5 shows one example of the physical activity amount data recorded in the memory 14. In this example, the lifestyle activity amount and the physical exercise amount performed in one day are individually recorded. The past data is also left in addition to the data for the current unit period (for the present week). As the content of the physical exercise amount and the lifestyle activity amount in the entire physical activity amount merely needs to be recognized, the form of recording the data may be "physical activity amount+physical exercise amount" or "physical activity amount+lifestyle activity amount" other than "lifestyle activity amount+physical exercise amount".

Therefore, in the present embodiment, the acceleration sensor 13 and the control unit 10 serve as physical activity amount recording means of the present invention.

(3) Displaying Performance Status

When the user instructs to "check performance status" from the operation unit 11, the control unit 10 reads the physical activity amount data for the current week from the memory 14 and tabulates the same, and displays a performance status check screen as shown in FIG. 6(*a*) on the display unit 15. In this screen, the progress bar on the upper side represents the achievement on the goal (23 exercises/week) of the physical activity amount, and the progress bar on the lower side represents the achievement on the goal (4 exercises/week) of the physical exercise amount. In each bar, the length of the entire bar indicates the goal amount, and the performed amount is drawn from the left end of the bar.

According to such a display, the remaining physical activity amount and the physical exercise amount necessary for achieving the goal of the current week can be recognized at one view.

FIGS. 6(*b*) and 6(*c*) show other display examples. In FIG. 6(*b*), the entire length of the bar corresponds to the goal (23 exercises/week) of the physical activity amount, and the goal of the physical exercise amount is shown in the middle of the bar (position of 4 exercises from the right end). The performed amount of lifestyle activity is drawn from the left end of the bar, and the performed amount of physical exercise is drawn from the right end of the bar. In the display example of FIG. 6(*c*), the performed amount of lifestyle activity is drawn on the left side and the performed amount of physical exercise is drawn on the right side with the reference point (position of 4 exercises from the right end) provided in the middle of the bar as the center. The remaining physical activity amount and the physical exercise amount necessary for achieving the goal of the current week can be recognized at one view according to such displays.

In the display example of FIG. 6(*d*), the physical activity amount of smaller than the reference intensity is also displayed in addition to the physical activity amount of greater than or equal to the reference intensity (3 mets). For instance, the reference intensity may not be met although the user feels as if he/she is actively moving. Whether the performed physical activity has an intensity contributing to goal achievement (i.e., whether effective in preventing lifestyle-related diseases) can be easily checked by looking at the display of FIG. 6(*d*), and thus the user can try to perform an active physical activity on a routine basis. For such a display, the control unit 10 needs to calculate and record the physical activity amount also with respect the physical activity of smaller than the reference intensity (white portion in the graph of FIG. 4).

Through the use of the physical exercise intensity meter 1 according to the present embodiment described above, the user can easily manage the performance status of the physical activity and of the physical exercise, and can easily understand the remaining physical activity amount necessary for achieving goal and the content thereof (whether physical exercise is necessary, or lifestyle activity is enough). Furthermore, since the intensity and the amount of physical activity such as walking, fast walking and jogging are automatically calculated and recorded, and distinction between the lifestyle activity and the physical exercise is automatically made, the user does not need to carry out a troublesome operation. This effectively assists the user in continuing the physical exercise (goal achievement).

The configuration of the embodiment described above merely illustrates one specific example of the present invention. The scope of the present invention is not limited to the above-described embodiment, and various modifications may be made within the scope of the technical scope. Preferred variants will be described below. Such variants may be appropriately combined.

<First Variant>

In the above-described embodiment, the physical activities of greater than or equal to the reference intensity are all target of recordation. However, it is preferable to perform the physical exercise of some time to a certain extent rather than discontinuously repeating the physical exercise of a short period of time in terms of enhancing the physical strength and in terms of improving the lifestyle. The physical activity amount may be recorded only when the physical activity of greater than or equal to the reference intensity is performed continuously for longer than or equal to a predetermined time instead of recording all physical activities.

For instance, if "continuously performed for longer than or equal to 30 minutes" is the recording condition in the graph of FIG. 4, the physical activity amount of the portion corresponding to the shaded portion 20 and the gray portion 23 is not recorded, and only the physical activity amount of the portion corresponding to the shaded portion 21 and the gray portion 22 is the target of recordation. According to such a configuration, since the physical activity of greater than or equal to the reference intensity is not recorded unless performed for longer than or equal to 30 minutes, the user can be reminded of consciousness (forwardness) for carrying out active physical activity.

The predetermined time does not need to be a fixed value, and may be dynamically changed according to the intensity of the physical activity. For instance, if continuous performance of a predetermined physical activity amount as in "continuous performance of greater than or equal to 1 exercise" is the recording condition, the physical activity of greater intensity can be recorded in a shorter time. According to such a recording condition, the gray portion 23 of the graph of FIG. 4 has a large intensity and thus is the target of recording. According to such a configuration, the motivation to perform the physical exercise of large intensity can be provided to the user.

<Second Variant>

In the embodiment described above, determination on "physical exercise" or "lifestyle activity" is made depending on whether or not the intensity of the physical activity is greater than or equal to, or smaller than 4 mets. Actually, however, the user may perform walking of smaller than 4 mets as the physical exercise, or may run (although for a short time) in the daily life.

The "continuously performed physical activity amount" is calculated as in the first variant, and determination of "physical exercise" or "lifestyle activity" may be made depending on whether the magnitude of the physical activity amount is greater than or equal to, or smaller than a threshold value. For instance, determination is made as "physical exercise" if continuously performed for greater than or equal to 1 exercise, and determination is made as "lifestyle activity" if smaller than 1 exercise. Thus, determination is made as "physical exercise" if continuously performed for twenty minutes even with walking of 3 mets, and determination is made as "lifestyle activity" if only performed for about a few minutes even with running of 10 mets. Determination complying with the actual condition is thus made.

<Third Variant>

The physical activity (physical exercise, lifestyle activity) includes various types, and thus it is nearly impossible to detect all types of physical activities and accurately calculate the performed amount with a single device. For instance, the physical activity of the types walking, fast walking, and jogging can be detected using the acceleration sensor as in the embodiment described above, but the lifestyle activity such as physical exercise including swimming and golf, and floor cleaning and gardening cannot be detected.

The physical activity of a type (i.e., physical activity of the type difficult to automatically detect) different from the physical activity that can be automatically detected may be manually input by the user.

A specific configuration is shown in FIG. 7. A physical activity intensity table 30 in which the type and the intensity of the physical activities are corresponded is prepared in advance in the memory 14. When the user instructs to "input physical activity" from the operation unit 11, an input screen 31 as shown in FIG. 7 is displayed on the display unit 15. The user uses the operation unit (input means) 11 to input the type and the performing time of the physical activity. After the input is completed, the control unit 10 references the physical activity intensity table 30, and calculates the physical activity amount from the input intensity and the performing time of the physical activity. For instance, if "golf (use cart), 120 minutes" is input, this is two hours of physical exercise of 3.5 mets, and thus the calculation result of "physical exercise of 7 exercises" is obtained; and if "pulling weeds of garden, 30 minutes" is input, this is 0.5 hours of lifestyle activity of 4.5 mets, and thus the calculation result of "lifestyle activity of 2.25 exercises" is obtained. This calculation result is recorded in the physical activity amount data of the memory 14, similar to the physical activity amount detected by the acceleration sensor.

According to such a configuration, even the physical activity amount for the physical activity of a type difficult to automatically detect can be recorded, and the convenience of the physical exercise intensity meter 1 is enhanced.

<Fourth Variant>

The goal achievement at the terminating time point of the current unit period is estimated (presumed) from the history of the physical activity amount stored in the past unit period and the history of the physical activity amount recorded from the start to the current time point of the current unit period, and such presumed achievement is preferably presented to the user.

Figure 8:
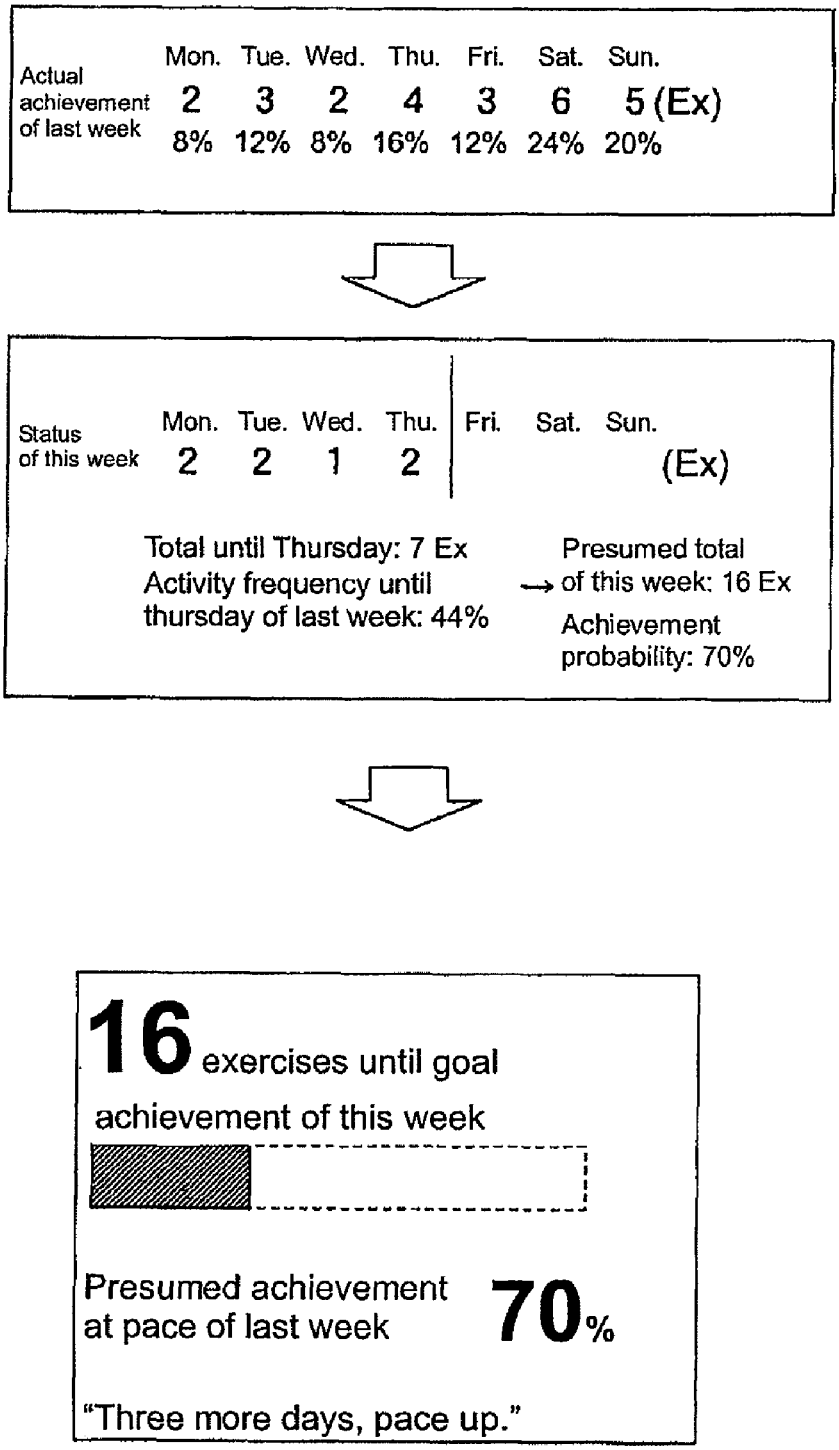
FIG. 8 is a view showing a calculation example of a presumed achievement based on the past history.

As shown in FIG. 8, for example, assume the history of the physical activity amount of one week (Monday to Sunday) of last week is "Mon: 2, Tue: 3, Wed: 2, Thu: 4, Fri: 3. Sat: 6, Sun: 5) (unit is exercise), and the history of Monday to Thursday (today) of this week is "Mon: 2, Tue: 2, Wed: 1, Thu: 2). Last week, the physical activity of 44% (11 exercises) of the total activity amount (25 exercises) are performed at the time point of Thursday, and thus if the physical activity is performed at the same pace this week, the presumed total activity amount at the terminating time point of this week will be, 16 exercises(=7/0.44)

and the presumed achievement of this week is obtained as,

70% (=(16/23)×100)

The presumed achievement calculated in such a manner is displayed as shown in FIG. 8, so that the user can adjust the pace of performing the physical activity.

Instead of comparing with the history of one week of last week, it is also preferable to compare with the history of one week of one month before or compare with the past statistical value (average value for the past month etc.).

<Fifth Variant>

In order to effectively and safely perform the physical exercise, it is important to set an appropriate physical exercise content and goal according to the physical strength of the user himself/herself. Effects may not instantly appear with the physical exercise lower than the physical strength level, or the user may get injured or may not be able to continue the physical exercise if an excessive physical exercise not suited to his/her physical strength is performed, and the expected effects may not be obtained. Therefore, it is desirable to consult a professional on physical exercise when determining the goal value to set in the physical exercise intensity meter 1.

Furthermore, whether to change the setting of the goal in the physical exercise intensity meter 1 may be switchable, and for example, input of password may be requested so that only a qualified person can change the goal. By utilizing such a function, only the management instructor may be permitted to change the setting of the goal and the actual user may be prohibited to change the goal without asking.

<Other Variants>

As the energy consumption amount differs among individuals although the physical exercise of the same content is performed, the physical exercise effect that is actually obtained may vary. The intensity thus may be corrected based on the personal attribute of the user. The gender, age, height, BMI, body composition value, basal metabolism, and the like are assumed as personal attributes that influence the energy consumption amount. The magnitude of influence the value of the personal attribute has on the energy consumption amount is defined through clinical tests. The correction coefficient for every value or layer of the personal attribute may be defined and used in the intensity calculation formula described above, so that the difference in physical exercise effect due to difference in personal attributes may be appropriately corrected.

The unit period may not be "one week". The unit period may be freely selected such as five days, ten days, or one month. However, since the planning and the goal management of the physical exercise plan can be easily carried out if the length of the unit period matches the life cycle of the user, "one week" is assumed as most preferable for the unit period.

The invention claimed is:

1. A physical exercise assisting device comprising:

a physical activity detector detecting a physical activity of a user;

a processor receiving the physical activity from the physical activity detector and calculating a physical activity amount; and a controller that classifies the physical activity amount into a lifestyle activity amount and a physical exercise amount using a unit of MET such that physical activity amounts greater than or equal to 3 METs and smaller than 4 METs are classified as the lifestyle activity amount and that physical activity amounts greater than or equal to 4 METs are classified as the physical exercise amount, wherein the physical activity amount is based on all movements that consume greater energy than in a resting state of the user, the physical exercise amount is based on the activity that is performed intentionally according to a plan for the purpose of maintaining and enhancing physical strength of the user, and the lifestyle activity amount is the physical activity amount from which the physical exercise amount is subtracted;

a physical activity amount recorder recording the physical exercise amount and the lifestyle activity amount, based on performance of the user during a predetermined period of time;

a goal storage unit storing a first goal for the physical exercise amount and a second goal for the lifestyle activity amount; and a display displaying a first goal achievement status of the physical exercise amount and, at the same time, a second goal achievement status of the lifestyle activity amount based on the physical exercise amount and the lifestyle activity amount recorded in the physical activity amount recorder and the first and second goals stored in the goal storage unit.

2. The physical exercise assisting device according to claim 1, wherein the physical activity amount recorder includes a detector detecting a physical activity of a user, and calculating the intensity and the physical activity amount of the physical activity performed by the user based on the detection result of the detector.

3. The physical exercise assisting device according to claim 2, wherein the physical activity amount recorder records the physical activity amount only when the physical activity of greater than or equal to the reference intensity is continuously performed for longer than or equal to a predetermined time.

4. The physical exercise assisting device according to claim 3, wherein the physical activity amount recorder dynamically changes the length of the predetermined time according to the intensity of the physical activity.

5. The physical exercise assisting device according to claim 3 or 4, wherein the physical activity amount recorder determines whether to assume a physical activity amount as the physical exercise amount or a lifestyle activity amount based on a magnitude of the continuously performed physical activity amount.

6. The physical exercise assisting device according to claim 2, 3 or 4, wherein the physical activity amount recorder determines whether to assume a physical activity amount as the physical exercise amount or the lifestyle activity amount based on the magnitude of the calculated intensity.

7. The physical exercise assisting device according to claim 2, 3 or 4, wherein the physical activity amount recorder includes a physical activity intensity table in which type and intensity of a physical activity are correlated, and an input for the user to input a type and a performing time of the physical activity, and the physical activity recorder calculates and records a physical activity amount for a physical activity of a type different from the physical activity detectable with the detection means based on the input of the user.

8. The physical exercise assisting device according to claim 1, 2, 3 or 4, wherein the physical activity recorder records a performed physical activity amount for a physical activity of smaller than the reference intensity; and the display displays the physical activity amount of smaller than the reference intensity in distinction from the physical activity amount of greater than or equal to the reference intensity.

9. The physical exercise assisting device according to claim 1, 2, 3 or 4, further comprising an achievement estimating unit estimating a goal achievement at a terminating time point of a current unit period from a history of the physical activity recorded in the past unit period and a history of the physical activity amount recorded from the start to the current time point of the current unit period.

10. The physical exercise assisting device according to claim 1, 2, 3 or 4, further comprising a goal setting unit setting the goal, the goal setting unit being switchable to change or not change the setting of the goal.

* * * * *